US007363846B1

(12) United States Patent
Dean et al.

(10) Patent No.: US 7,363,846 B1
(45) Date of Patent: Apr. 29, 2008

(54) PROJECTILE RESISTANT ARMOR

(75) Inventors: W. Clark Dean, Simsbury, CT (US); Kevin G. Hawes, Windsor Locks, CT (US); Robert Wichowski, Westfield, MA (US); Thinh Pho, Westfield, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 290 days.

(21) Appl. No.: 10/891,435

(22) Filed: Jul. 14, 2004

(51) Int. Cl.
*F41H 1/02* (2006.01)

(52) U.S. Cl. ..... 89/36.05; 2/2.5

(58) Field of Classification Search ..... 89/36.05; 2/2.5; 428/911
See application file for complete search history.

(56) References Cited

U.S. PATENT DOCUMENTS

| | | | | | |
|---|---|---|---|---|---|
| 1,465,767 | A | * | 8/1923 | Leo | 428/55 |
| 1,513,766 | A | * | 11/1924 | Spooner | 428/121 |
| 1,739,112 | A | * | 12/1929 | Wisbod | 2/2.5 |
| 2,747,190 | A | * | 5/1956 | Foster | 2/2.5 |
| 2,748,391 | A | | 6/1956 | Lewis, Jr. et al. | |
| 2,773,791 | A | * | 12/1956 | Maciver | 428/198 |
| 2,808,588 | A | * | 10/1957 | Persico | 2/2.5 |
| 3,061,839 | A | * | 11/1962 | Foster | 2/2.5 |
| 3,130,414 | A | * | 4/1964 | Bailey et al. | 2/2.5 |
| 3,392,406 | A | * | 7/1968 | Pernini et al. | 2/2.5 |
| 3,409,907 | A | | 11/1968 | Barratt | |
| 3,452,362 | A | | 7/1969 | Korolick et al. | |
| 3,829,899 | A | * | 8/1974 | Davis | 2/2.5 |
| 3,867,239 | A | * | 2/1975 | Alesi et al. | 428/48 |
| 4,198,707 | A | * | 4/1980 | Haupt et al. | 2/2.5 |
| 4,241,457 | A | * | 12/1980 | Klein et al. | 2/2.5 |
| 4,292,882 | A | | 10/1981 | Clausen | |
| 4,316,286 | A | * | 2/1982 | Klein | 2/2.5 |
| 4,391,178 | A | * | 7/1983 | Pagano | 89/36.08 |
| 4,633,528 | A | * | 1/1987 | Brandt | 2/2.5 |
| 4,923,728 | A | | 5/1990 | Snedeker | |
| 5,102,723 | A | * | 4/1992 | Pepin | 428/223 |
| 5,221,807 | A | | 6/1993 | Vives | |
| 5,729,830 | A | * | 3/1998 | Luhtala | 2/2.5 |
| 5,771,489 | A | * | 6/1998 | Snedeker | 2/2.5 |

(Continued)

FOREIGN PATENT DOCUMENTS

| | | |
|---|---|---|
| DE | 21 46 265 | 3/1973 |

(Continued)

OTHER PUBLICATIONS

Web site print out for Dyneema UD. www.dsm.com/en_us/html/hpf/dyneema-ud.htm.

(Continued)

*Primary Examiner*—Stephen M Johnson
(74) *Attorney, Agent, or Firm*—Carlson, Gaskey & Olds

(57) ABSTRACT

A body armor assembly includes a plurality of rigid tiles that are supported in a manner to provide movement and flexibility while still providing the protection of rigid armor. In a disclosed example, a tile holder maintains a plurality of tiles in a selected alignment. The tile holder maintains a minimum overlap dimension between adjacent tiles. Some of the tiles are maintained by the tile holder in a manner that allows for the overlap dimension to increase beyond the minimum overlap dimension. In a disclosed example, at least two rigid layers have at least one ballistic material layer between them to provide a rigid armor material composition.

21 Claims, 7 Drawing Sheets

U.S. PATENT DOCUMENTS

| | | | | |
|---|---|---|---|---|
| 5,804,757 | A | 9/1998 | Wynne | |
| 5,996,115 | A | 12/1999 | Mazelsky | |
| 2003/0192426 | A1* | 10/2003 | Peretz | 89/36.02 |

FOREIGN PATENT DOCUMENTS

| | | |
|---|---|---|
| FR | 476.476 | 8/1915 |

OTHER PUBLICATIONS

PCT International Search Report for Application No. PCT/US2005/024775 mailed Nov. 9, 2005.

Written Opinion of the International Searching Authority for Application No. PCT/US2005/024775 mailed Nov. 9, 2005.

* cited by examiner 100
102'
104'
106'
120
124
126
102'
104'
124
120
126
104'
102'
106'

102"
104"
106"
166
168
164
160
162
102"
104"
168
166
120"
164
160
104"
102"

102"
104"
106"
166
168
160
162
102"
104"
166
168
120
160
162
104"
102"

PROJECTILE RESISTANT ARMOR

FIELD OF THE INVENTION

This invention generally relates to armor. More particularly, this invention relates to multilayer armor that can be incorporated into a flexible body armor assembly, for example.

DESCRIPTION OF THE RELATED ART

A variety of configurations of projectile-resistant armor are known. Some are used on vehicles while others are specifically intended to protect an individual. Some materials or material combinations have proven useful for either application.

Body armor for protecting an individual's vital organs, for example, usually comprises a ballistic material. Known materials for such purposes include those sold under the trade names KEVLAR, DYNEEMA, SPECTRA and TWARON. Such ballistic materials typically are fabric-like and provide protection while maintaining flexibility. Multiple layers of such fabrics are known to be useful for body armor that provides protection against low or moderate velocity projectile threats.

One shortcoming of such arrangements is that additional layers are required to provide additional protection. With the addition of each layer, the weight increases and the flexibility decreases. Increased weight and reduced flexibility decrease an individual's freedom of movement. In some instances, such reduced flexibility or increased weight can outweigh the advantage of having the additional protection such as armor provides.

Other body armors are rigid and include metal or ceramic materials, for example. In one example, a rigid metal plate is placed in front of a plurality of layers of ballistic material to provide protection beyond that available using only the ballistic, cloth-like material. A significant disadvantage with typical arrangements is that a solid plate extending over the majority of an individual's thoracic and abdominal regions tends to be uncomfortable and limits the individual's freedom of movement. There is a need for an arrangement that combines the additional safety of rigid body armor with the advantages of flexible body armor.

Several flexible body armor arrangements that include hard or rigid pieces have been proposed. Examples are shown in U.S. Pat. Nos. 5,804,757 and 5,996,115. Such arrangements have not proven to be widely accepted or to perform in a manner that has satisfied the needs of the military or law enforcement agencies, for example.

This invention provides an improved arrangement. One disclosed example provides improved flexible body armor that provides protection similar to that available from rigid body armors while offering the versatility of employing readily available materials arranged in a modular manner that is superior to other flexible armor arrangements.

SUMMARY OF THE INVENTION

An example, disclosed armor assembly includes a plurality of tiles. A flexible tile holder maintains a minimum overlap dimension of overlapping portions of adjacent tiles. The tile holder allows the overlap dimension of at least some adjacent tiles to increase beyond the minimum overall dimension.

In one example, the tile holder maintains some of the tiles in a plurality of longitudinal rows and some of the tiles in a plurality of transverse rows. The overlap dimension of the tiles in each of the transverse rows remains essentially constant. In one example, the overlap dimension of the tiles in at least one of the longitudinal rows remains essentially constant. In that example, the tile holder also allows the overlap dimension of tiles in at least one other longitudinal row to increase beyond the minimum overlap dimension.

The unique arrangement and support of tiles allows the armor assembly to assume complex curvatures. The disclosed examples provide the protection of rigid body armor while providing the flexibility and freedom of movement associated with flexible body armor.

The various features and advantages of this invention will become apparent to those skilled in the art from the following detailed description of a currently preferred embodiment. The drawings that accompany the detailed description can be briefly described as follows.

DETAILED DESCRIPTION

Figure 1:
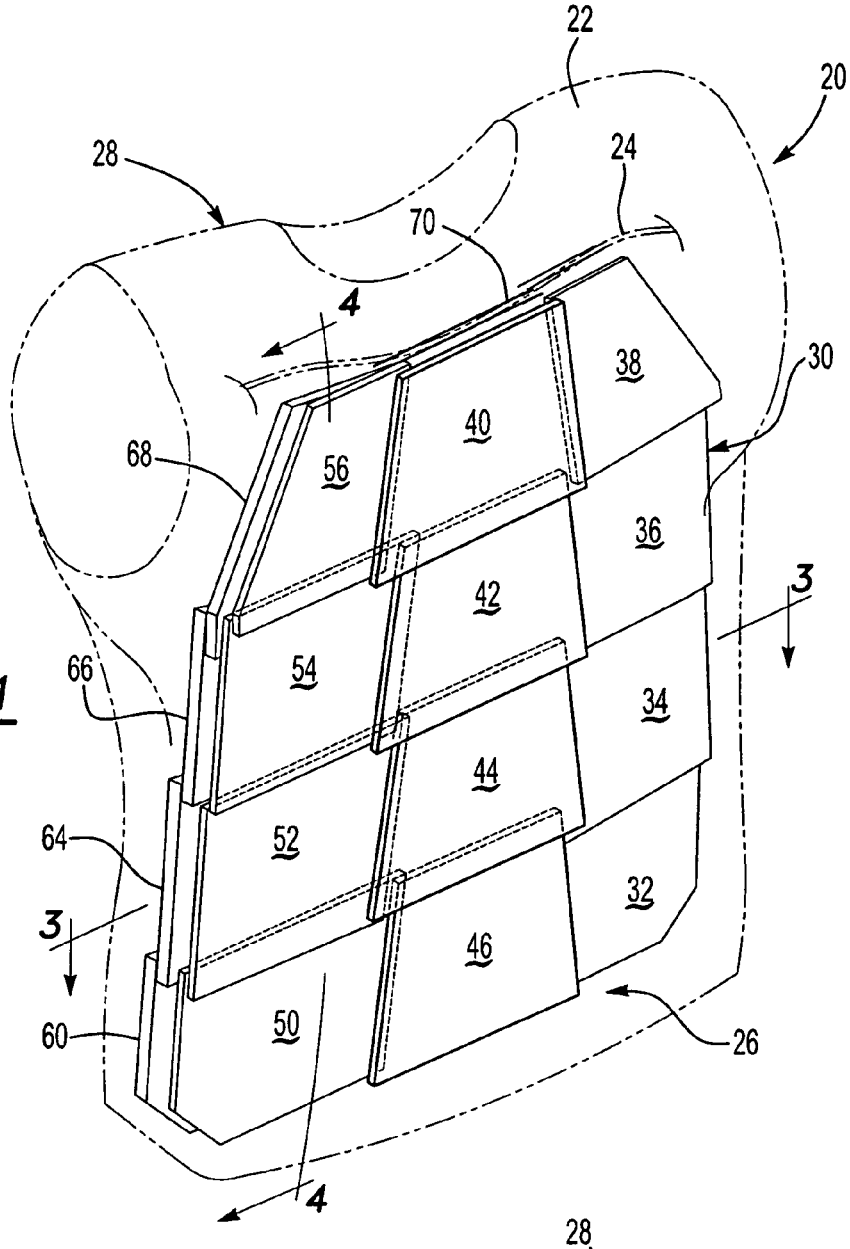
FIG. 1 is a diagrammatic, perspective illustration of an example body armor assembly.

FIG. 1 shows body armor 20 that can be worn by an individual to protect at least the thoracic and abdominal region of the body. A vest 22 is made of a ballistic material. One example ballistic material has fibers consisting of long molecular chains produced from poly-paraphenylene terephthalamide. One such commercially available material is sold under the trade name KEVLAR. One example includes a vest 22 that is an Outer Tactical Vest used by the military and is known as Inteceptor Body Armor. In the illustrated example, the vest 22 includes a pocket 24 on a front side 26 of the vest 22. A similar pocket (not illustrated) is provided on a rear side 28 of the vest 22.

An armor assembly 30 is received within the pocket 24. As can be appreciated from FIG. 2, an armor assembly 30 is provided on the front side 26 and the rear side 28 of the example body armor 20. Each armor assembly 30 includes a plurality of rigid tiles. This example includes tiles 32, 34, 36 and 38 in a longitudinal row. Tiles 40, 42, 44 and 46 are aligned in a second, longitudinal row. Another longitudinal row includes the tiles 50, 52, 54 and 56. The tiles 38, 40 and 56 are aligned in an example transverse row. Similarly, the tiles 32, 46 and 50; 34, 44 and 52; and 36, 42 and 54 are aligned in respective transverse rows.

The example armor assembly 30 includes rigid tiles arranged in a plurality of longitudinal rows and a plurality of transverse rows. The term "longitudinal" as used in this description is intended to convey a sense of direction that is generally parallel to the spine of an individual wearing the armor. The term "transverse" is intended to mean a direction generally perpendicular to the longitudinal direction.

As can be appreciated from FIGS. 1-4, the example armor assembly 30 includes a first plurality of tiles and a second plurality of tiles. In the illustrated example, tiles 60, 64, 66, 68 and 70 (visible in FIG. 1) are part of the second plurality of tiles. In the illustrated example, the tile 70 and the others in the same longitudinal row are wider than those from the first plurality in the corresponding longitudinal row. In one example, the second plurality of tiles are sized to nest in the steps formed by the overlap of the first plurality of tiles to reduce the overall thickness of the armor assembly 30.

The rigid tiles are maintained in the selected arrangement by a tile holder (to be described in more detail below) that allows the tiles to be articulated in a manner that makes the armor assembly 30 and the overall body armor 20 flexible in that it accommodates body movements in a manner that is not restrictive of an individual's freedom of movement. The example body armor 20 allows an individual to respond to a threat without limiting the individual's freedom of movement and, therefore, increases the probability of survival.

Figure 3:
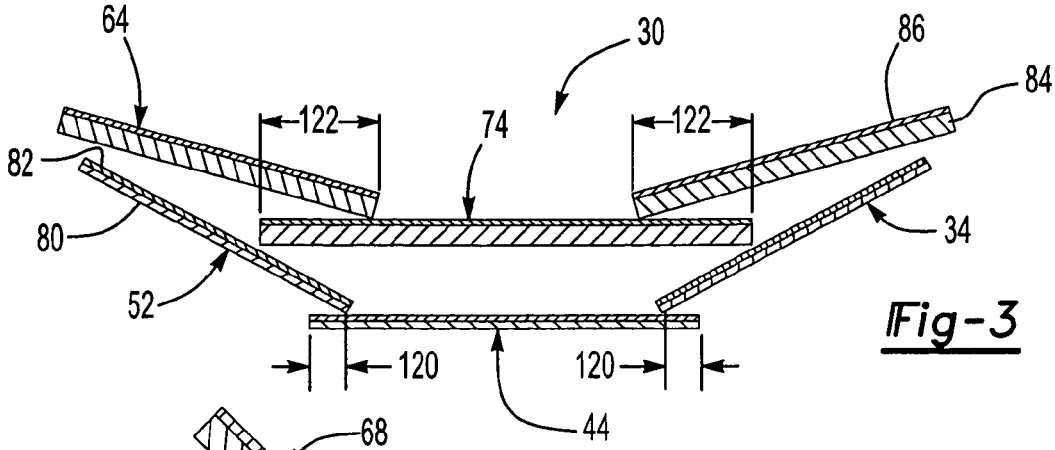
FIG. 3 is a schematic, cross-sectional illustration taken along the lines 3-3 in FIG. 1.
Figure 4:
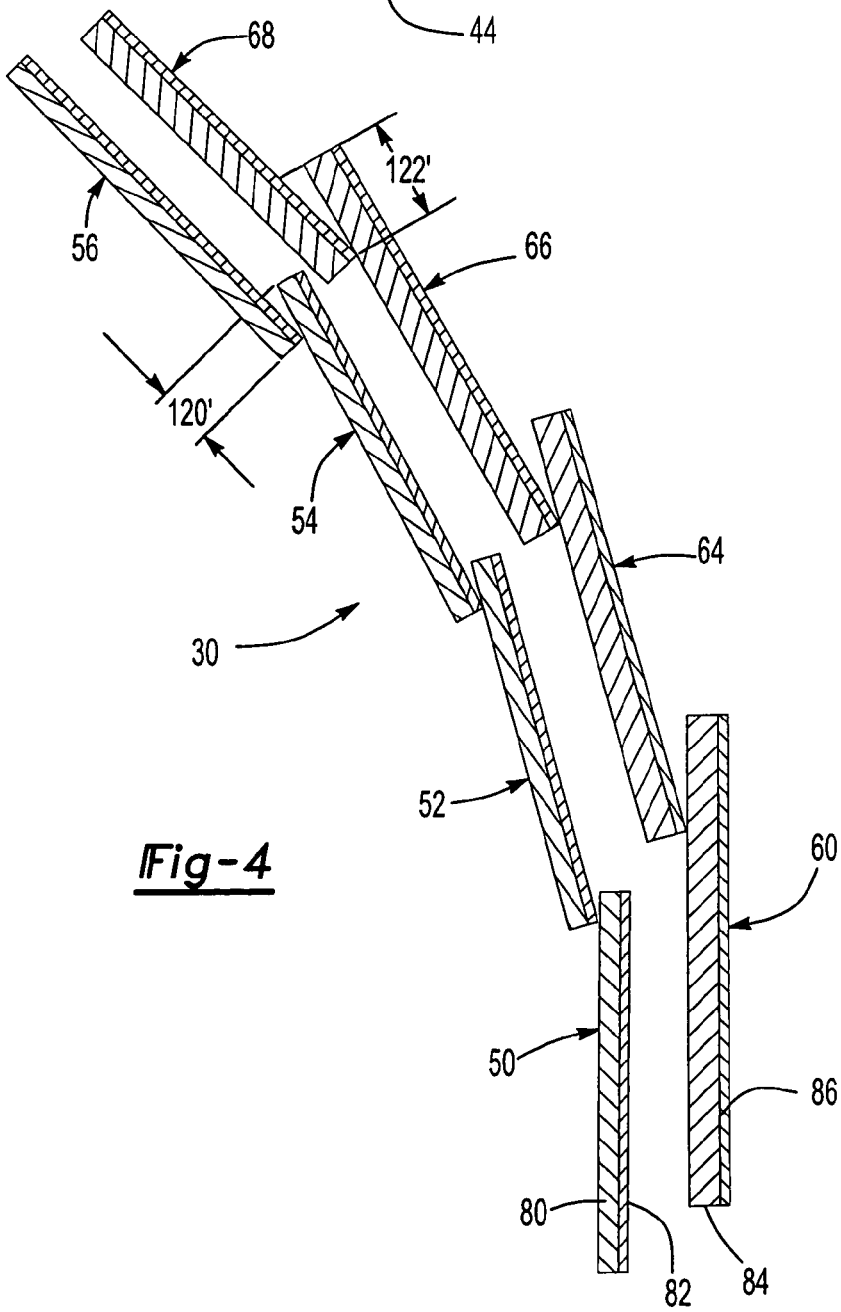
FIG. 4 is a schematic, cross-sectional illustration taken along the lines 4-4 in FIG. 1.

As can be appreciated from the cross-sectional, schematic illustrations of FIGS. 3 and 4, the armor assembly 30 is capable of assuming complex curvatures. The generally concave curvature in the transverse direction as shown in FIG. 3 is possible at the same time that the generally convex curvature in the longitudinal direction of FIG. 4 is possible. Accordingly, the armor assembly 30 can conform to an individual's body and allow them to bend in a direction where their shoulders are drawn toward their knees, for example. The combination of curvatures shown in FIGS. 3 and 4 results in a generally saddle-shaped, complex curvature of the armor assembly 30.

The rigid tiles are arranged so that each tile overlaps with an adjacent tile to ensure that there are no gaps between the rigid tiles through which a projectile may penetrate the armor. The tile holder ensures that at least a minimum overlap dimension is always maintained between adjacent tiles.

The rigid tiles may comprise a variety of materials. In the illustrated example, the tiles in the first plurality of tiles (i.e., tiles 40-46, for example) comprise a ceramic layer 80 that is bonded to a titanium layer 82. In one example, the ceramic layer is a silicon carbide ceramic and has a thickness of 0.125 inches (0.318 cm) and the titanium layer has a thickness of 0.032 inches (0.081 cm). The second plurality of tiles (i.e., tiles 70, 72, 74 and 76 in FIG. 4) have a ballistic material layer 84 bonded to a titanium layer 86. In one example, the ballistic material 84 is a material that has high performance polyethylene fibers arranged in layers. The fibers are oriented parallel to each other in each layer and each adjacent layer has fibers arranged perpendicular to the fibers in the adjacent layers. One such example material is sold under the trade name DYNEEMA. In one example, the ballistic material layer 84 has a thickness of 0.3 inches (0.76 cm) and the titanium layer 86 has a thickness of 0.032 inches (0.081 cm).

One aspect of the disclosed arrangement is that it includes rigid tiles having a sequence of materials arranged such that a rigid layer such as the layer 80 encounters a projectile prior to the ballistic material layer 84 encountering the projectile. The rigid layer 80 provides an impact layer that begins deformation of a projectile before it contacts the ballistic material layer 84 and its backup layer 86, which increases the so-called wadding effect of the ballistic material (as will be explained more below). Another feature of the disclosed example is that the ballistic material layer 84 is between rigid layers 80, 82 on one side and 86 on the other side. The example arrangement is effective for deforming and stopping a projectile so that it becomes effectively trapped by the armor assembly 30 and will not penetrate any of the layers of the vest 22. In other words, the plurality of tiles of the armor assembly 30 when placed in front of a ballistic material vest provide body armor 20 that is effective for stopping many types of projectiles.

Figure 5:
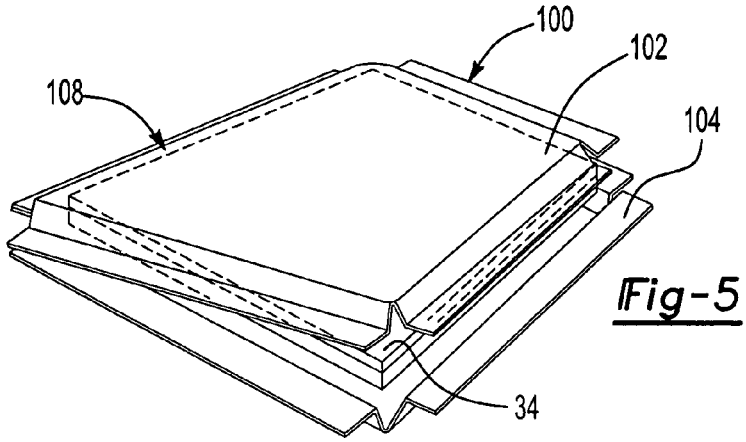
FIG. 5 is a diagrammatic illustration of a selected portion of an example tile holder.
Figure 6:
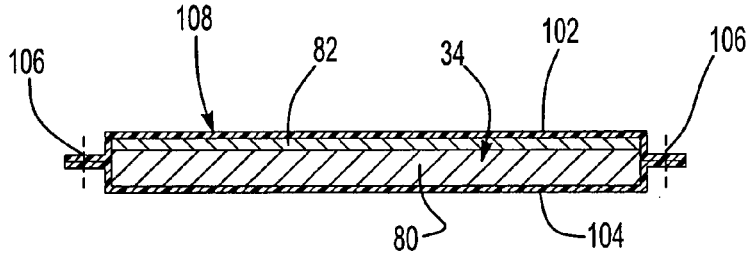
FIG. 6 is a cross-sectional illustration of an example portion of the embodiment of FIG. 1.

Referring to FIGS. 5 and 6, a portion of an example tile holder 100 includes a first material layer 102 on one side of the tile 34 and a second material layer 104 on an opposite side. In one example, a ballistic material such as KEVLAR is used for the layers 102 and 104. In this example, the material layers 102 and 104 are joined at seams 106 to establish a pocket 108 that receives the tile 34. In one example, the pocket 108 is closed around the entire periphery of the tile 34. The same would be true of other tiles in the assembly (only tile 34 is used as an example in FIGS. 5 and 6).

In another example, pockets 108 are not closed around the entire periphery of each tile. In still another example, the material layers 102 and 104 are placed on opposite sides of the tiles in a manner sufficient to maintain the tiles in a desired alignment without establishing "pockets." In one example, the materials 102 and 104 comprise a plurality of straps or adhesive-backed fabric tape.

FIG. 6 schematically shows, in cross-section, an example pocket 108 surrounding an example tile 34 where the pocket fits very snuggly around the tile. The seams 106 in one example are established by stitching the layers of material 104 and 102 together along the seam lines. In another example, an adhesive is used to establish the seams 106.

The tile holder 100 maintains the tiles in a selected alignment in a manner that ensures a minimum overlap between adjacent tiles. The overlap dimension of at least some of the adjacent tiles is permitted to increase beyond the minimum overlap dimension, which allows relative movement between at least some of the tiles in a manner that allows for the armor assembly 30 to be flexible to accommodate an individual's body movements. In other words, the tile holder 100 maintains the minimum overlap dimension between all adjacent tiles while allowing that dimension to increase between at least some of the tiles.

In one example, the tiles that are adjacent to each other in transverse rows are maintained by the tile holder in a manner that keeps the overlap dimension essentially constant. In other words, the transverse rows are not extendable and not compressible in a transverse direction. The tile holder is flexible so that it allows the tiles to articulate relative to each other without substantially changing the overlap dimension.

Figure 7:
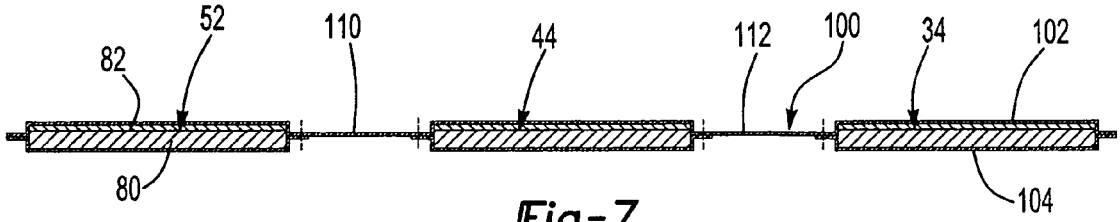
FIG. 7 schematically illustrates a portion of a process of assembling a tile holder useful with the embodiment of FIG. 1, for example.

As can be appreciated from FIG. 7, individual tiles from a transverse row in this example are contained within pockets 108 with connecting portions between them at 110 and 112. In this example, the material extending between the pockets 108 is the same material as the layers 102 and 104. In another example, separate pieces of material are connected between the pockets to provide the connecting portions 110 and 112.

Figure 8:
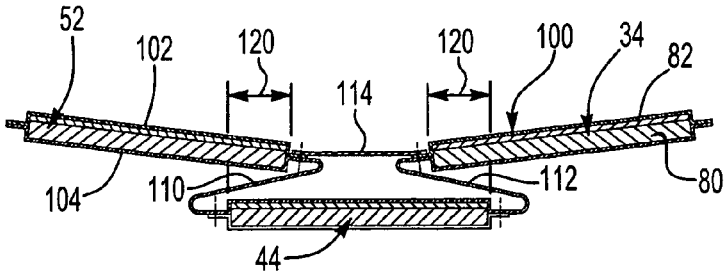
FIG. 8 schematically illustrates an example feature of an example tile holder.

FIG. 8 shows a connecting strap 114 that is secured near one end of the tile 52 and one end of the tile 34. The tile 44 is maintained between the other two and all three are connected by the strap 114 and the connecting portions 110 and 112. The arrangement shown in FIG. 8 includes somewhat exaggerated spacing between the tile 44 on the one hand and the tiles 52 and 34 on the other hand for illustration purposes. The tile 44 may be directly against the tiles 34 and 52 at the overlapping portions of the tiles, for example.

In the illustrated example, the connecting portions 110 and 112 and the strap 114 are all taut so that the relative positions of the tiles remains essentially constant in the transverse direction. The connecting portions 110 and 112 and the strap 114 are sized to maintain a minimum overlap dimension 120 at the adjacent interfaces of the tiles as can be appreciated from the illustration.

In another example, the strap 114 can be made longer so that it has some slack when the connecting portions 110 and 112 are fully extended. When the strap 114 is fully extended in such an example, at least one of the connecting portions 110 and 112 include some slack. In such an example, the overlap dimension 120 may extend beyond the minimum overlap dimension and the length of the strap 114 effectively maintains the minimum overlap dimension.

Figures 9, 11, 12:
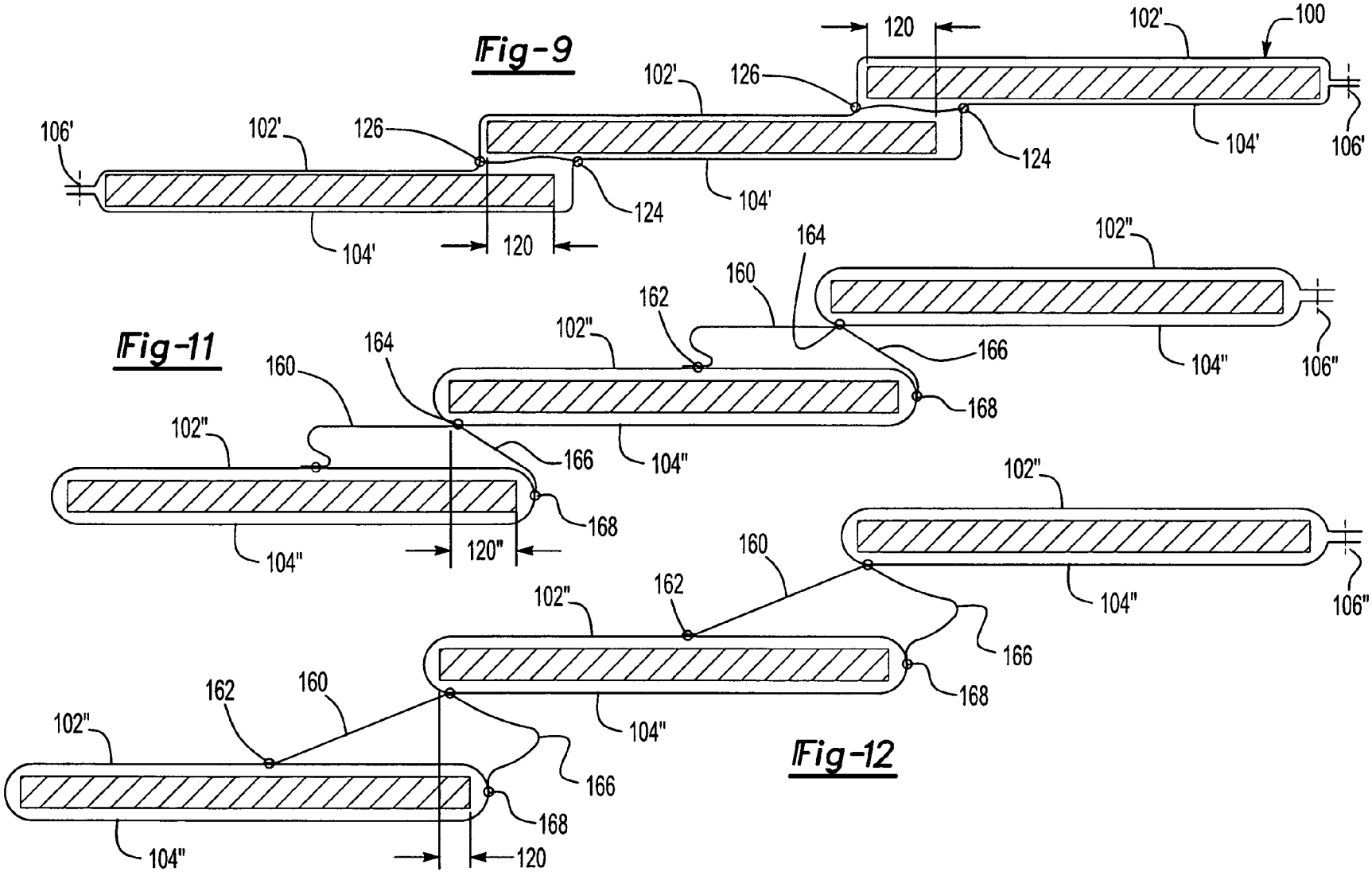
FIG. 9 schematically illustrates an example feature of another example tile holder.
FIG. 11 shows another example tile holder arrangement in a first condition.
FIG. 12 schematically shows the arrangement of FIG. 11 in a second condition.

FIG. 9 schematically shows another arrangement for keeping the overlap dimension 120 essentially constant. In the example of FIG. 9, the layer of material 102' and the layer of material 104' each comprises a strap that surrounds at least part of a corresponding tile. Stitching connections are made at 124 and 126 to secure the layers 102' and 104' together at the indicated locations. Such an arrangement has a non-extendable and non-compressible section of material between the stitching locations 126 and 124 so that the overlap dimension 120 remains essentially fixed.

In the examples of FIGS. 8 and 9, the tile holder 100 is flexible and includes hinge points that allow the tiles to articulate relative to each other in a manner that facilitates overall flexing of the armor assembly 30. In the examples of FIGS. 8 and 9, example transverse rows of tiles are maintained in a manner that the overlap dimension (when taken in a transverse direction) between adjacent tiles remains essentially fixed.

In the example of FIG. 1, at least one of the longitudinal rows is maintained by the tile holder 100 so that the overlap dimension between adjacent tiles remains essentially fixed. In other words, at least one of the longitudinal rows is essentially non-compressible and non-extendable in the longitudinal direction. At the same time, the tiles of that row can be articulated relative to each other so that flexibility of the armor assembly 30 is available.

In the example of FIG. 1, the other two longitudinal rows are maintained by the tile holder 100 in a manner that the overlap dimension is never less than a minimum dimension (shown at 120) but can be increased beyond that dimension.

Figure 10:
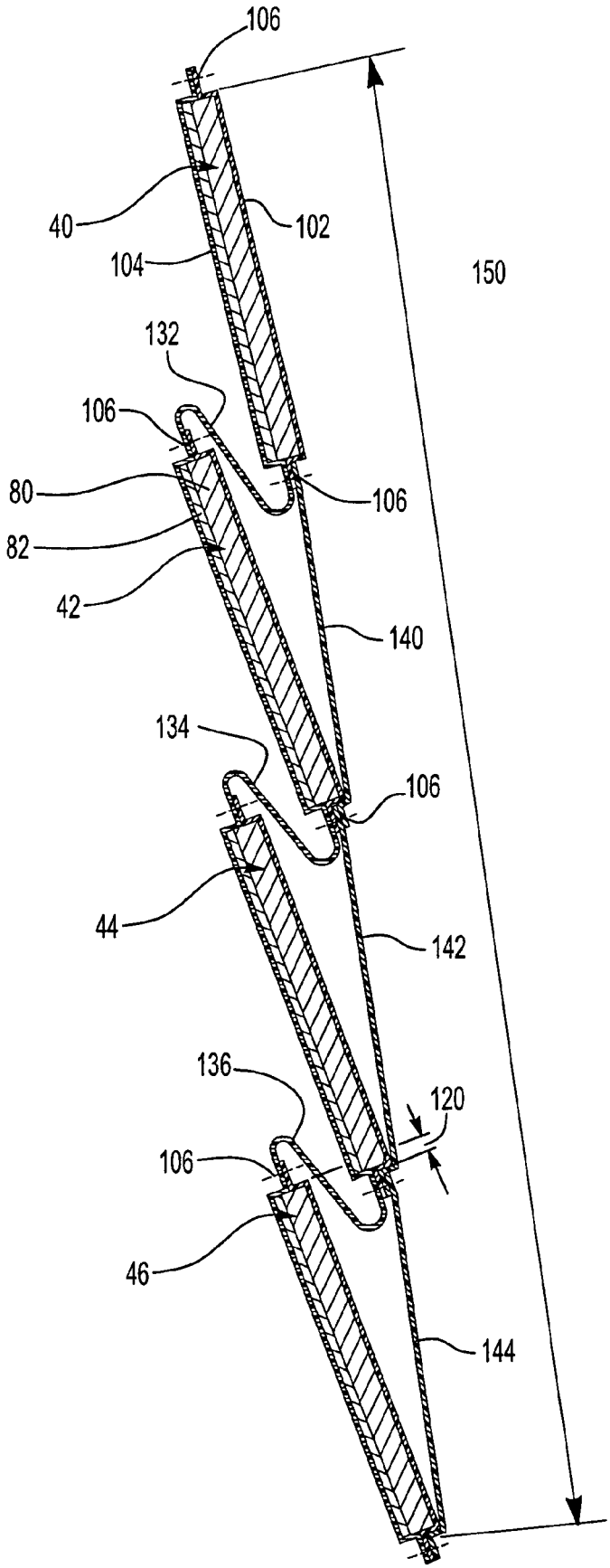
FIG. 10 schematically illustrates an example feature of another portion of an example tile holder.

FIG. 10 schematically shows one example arrangement of the tile holder 100 viewed from an opposite direction compared to FIG. 4. In this example, a plurality of straps 140, 142 and 144 are secured near one end of the tiles to provide a maximum extended dimension 150 of the longitudinal row. In the illustration of FIG. 10, the straps 140, 142 and 144 are secured between the lowermost (according to the drawing) ends of the tiles. When the straps 140, 142 and 144 are fully extended, the tile holder 100 maintains the minimum overlap dimension 120 between adjacent tiles.

Connecting portions 132, 134 and 136, each of which extends between the seams 106 of adjacent pockets, can be sized to be taut or to include some slack when the straps 140, 142 and 144 are in the fully extended position shown in FIG. 10.

In one example, the center longitudinal row is maintained essentially longitudinally fixed by having the connecting portions 132, 134 and 136 taut or snug and the straps 140, 142 and 144 fully extended. With such an arrangement, the overlap dimension 120 or 122 remains essentially constant.

The other longitudinal rows in the example of FIG. 1 (i.e., the outermost or most lateral rows) are arranged to provide for increasing the overlap dimension 120 or 122. For such longitudinal rows, the connecting portions 132, 134 and 136 may be eliminated. The uncompressible center row limits the extent to which the overlap dimension 120' or 122' may be increased. In another example, the connecting portions 132, 134 and 136 include slack for the rows where the overlap dimension can increase.

FIG. 4, for example, shows a longitudinal row of each of the pluralities of tiles in a flexed position where the tiles are articulated relative to each other. In each illustrated row, the overlap dimension between at least some of the tiles is larger than the minimum overlap dimension. For example, the overlap dimension 120' between the tiles 56 and 54 is greater than the minimum overlap dimension 120.

In the illustrated example, the separate pluralities of tiles each have a different minimum overlap dimension. The plurality of tiles that include a rigid layer of ceramic material 80 and a titanium layer 82 have a minimum overlap dimension of approximately ¼ of an inch (0.635 cm). Such a minimum overlap dimension is sufficient to achieve the same effect as if the projectile hit a center of one of the tiles even though the projectile hits near the overlapping portions of the tiles. The tiles having a ballistic material layer 84 secured to a titanium layer 86 have a second, larger minimum overlap dimension. In one example, where the layer 84 comprises DYNEEMA, a minimum overlap of approximately ¾ inch (1.91 cm) is always maintained at 122. Such a minimum overlap ensures that a projectile hitting near the overlapping portions of the tiles has no greater chance of penetrating the armor than when a similar projectile hits a center of one of those tiles, for example.

FIGS. 11 and 12 schematically illustrate another arrangement for maintaining tiles with a tile holder in a manner that maintains a minimum overlap dimension that allows for that overlap dimension to be increased. In the example of FIG. 11, connecting members, which are straps in this example, have a first portion 160 extending between a connection location 162 associated with a central portion of one tile and another connection location 164 associated with an end of another tile. The connecting members each have a second portion 166 extending between the connection location 164 and another connection location 168 associated with an end of the tile with which the connection location 162 is associated. As can be appreciated from FIG. 11, such a connecting member is associated with each set of adjacent tiles.

In the position of FIG. 11, the second portion 166 of each connecting member is fully extended and the overlap dimension 120" is at a maximum. In the position shown in FIG. 12, the first portion 160 of each connecting member is fully extended, maintaining the minimum overlap dimension 120 between adjacent tiles. At the same time, the first and second portions 160 and 166 allow for articulating the tiles relative to each other, for example, by pivoting about an axis that extends into the page.

The example tile holders 100 allow tiles in longitudinal rows to pivot about transversely oriented axes. Tiles in the transverse rows can pivot about longitudinally oriented axes.

One feature of the example of FIG. 1 is that it includes a first plurality of tiles and a second plurality of tiles. Each plurality of tiles is maintained within a separate tile holder in this example. Having different pluralities of tiles each made of different materials allows for replacing a layer or adding a layer to the armor assembly 30 to meet the needs of a particular situation. For example, one ballistic material may be more useful in stopping an expected type of projectile than another so that the second plurality of tiles (i.e., the one closer to a wearer's body in the illustrated example) could be replaced depending upon the expected, required protection. The example, modular system approach (compared to a mono-rigid design, for example) allows for substituting alternative materials within either or both of the pluralities of tiles to customize the protection afforded by the armor assembly 30. For example, the material selection may depend on a mission or threat profile or the suitability of one or more materials to satisfy given weight or cost considerations. Additionally, the tiles in each row of each plurality may be strategically sized to provide a desired amount of extremity protection (i.e., body parts outside of the thoracic and abdominal regions).

Figure 2:
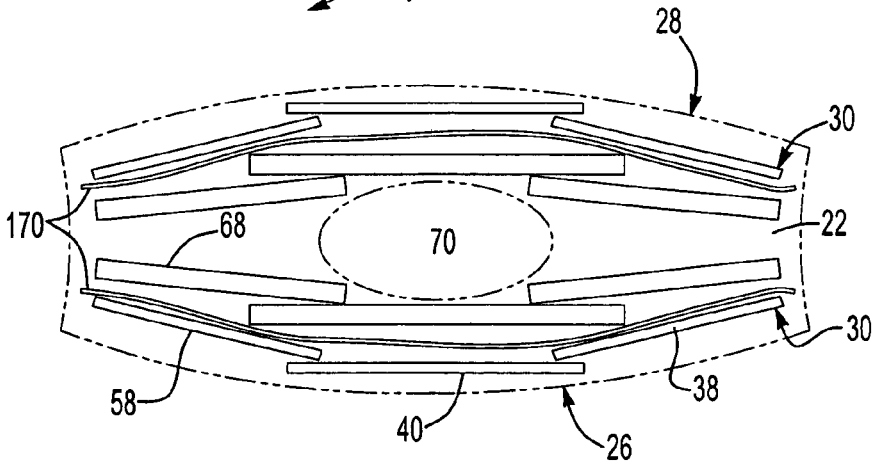
FIG. 2 is a schematic illustration of a top view of the embodiment of FIG. 1.

As can be appreciated from FIG. 2, one feature of one example is to include a layer of material 170 between the pluralities of tiles. In one example, the material 170 comprises a low friction material. In one particular example, the material 170 comprises polytetrafluoroethylene, which is sold under the trade name TEFLON.

The layer of material 170 between the pluralities of tiles reduces friction associated with relative sliding between the pluralities of tiles to further enhance the flexibility of the armor assembly 30 and the mobility of the individual wearing the armor assembly. In one example, the tile holders 100 comprise KEVLAR material and the layer of material 170 between them improves relative movement between the tile holders and the respective tiles.

In another example, the separate pluralities of tiles are integrated into a single plurality of tiles and each tile has a thickness corresponding to the combined tiles of the individual pluralities shown in FIGS. 1-4, for example. The selection of materials for each tile and the number of tiles to be used can be adjusted to accommodate the requirements of a particular situation. Those skilled in the art who have the benefit of this description will be able to make such a selection.

Another feature of the example of FIG. 1 is that each individual tile is shaped to accommodate an individual's anatomy and to minimize the thickness of the overall assembly. For example, the tiles along the central longitudinal row are all trapezoidal in shape. Having a trapezoidal shape minimizes the number of tiles at each corner of overlapping regions. For example, the overlapping portion of the tiles 42, 54, 56 and 40 are not stacked up to a thickness of four tiles at the intersection of those tiles. Instead, the trapezoidal shape of tiles 40 and 42 does not require those two tiles to be stacked on top of each other throughout the entire overlapping region especially at the lower left (according to the drawing) corner of the tile 40.

In one example, the tiles in the transverse rows of the second plurality of tiles are positioned to nest within steps formed by the transverse rows of the first plurality of tiles. The center row tiles, which are trapezoidal, are sized to nest within the trapezoidal space behind the center tile of each longitudinal row in the first plurality of tiles. Such an arrangement minimizes the overall thickness of the armor assembly 30.

Figure 13A:
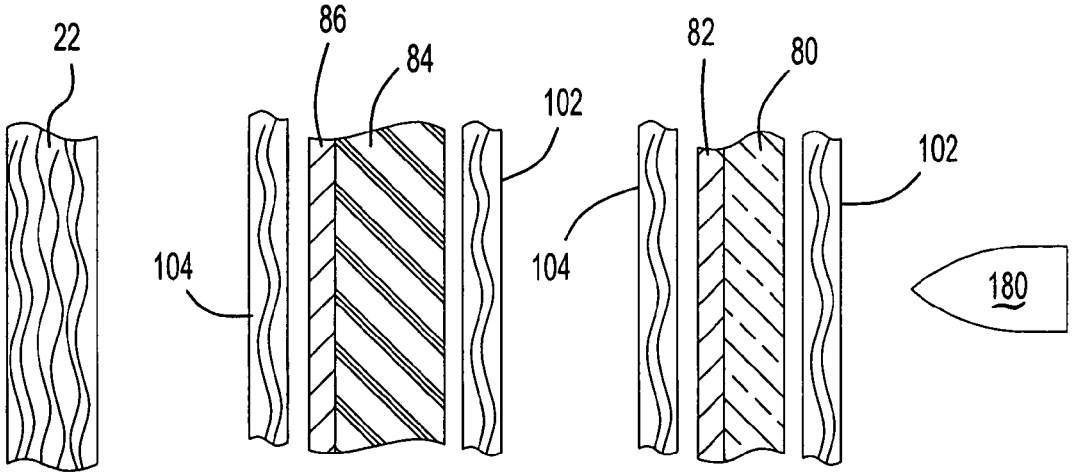
FIGS. 13A-13E schematically illustrate an example projectile interaction with the embodiment of FIG. 1.
Figure 13B:
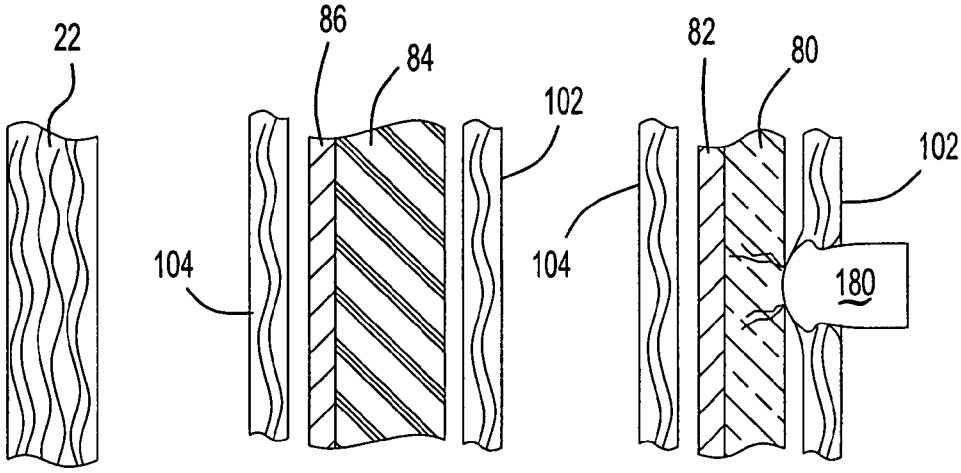
Figure 13C:
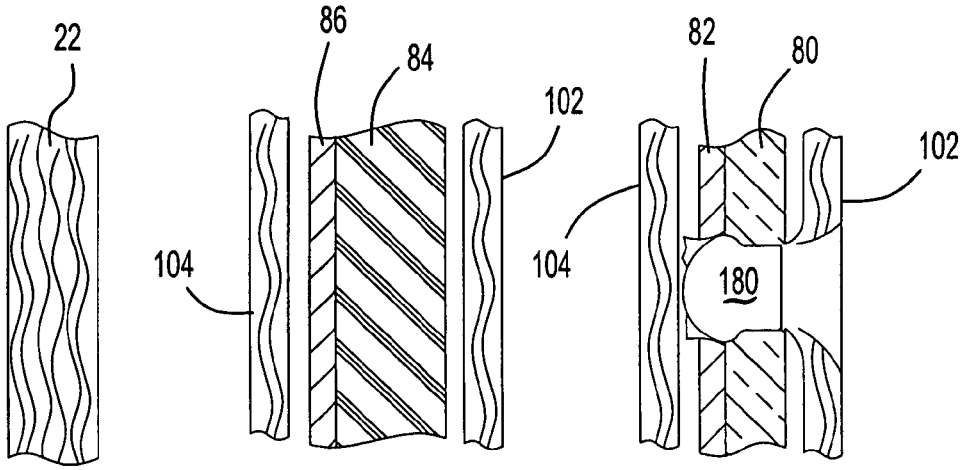

FIGS. 13A-13E schematically show the performance of the embodiment of FIG. 1. A projectile 180, such as a bullet, approaches the armor assembly 30 at high velocity and first penetrates the material layer 102 prior to contacting the rigid, ceramic layer 80. The material layer 102 acts to capture the projectile and ceramic fragments associated with the initial impact. The impact with the rigid, ceramic layer 80 deforms the leading edge of the projectile and locally shatters the brittle ceramic material resulting in a substantial removal of energy from the projectile. The deformed projectile proceeds into contact with the titanium layer 82. The reduced velocity at this second impact allows bending and tearing of the titanium layer 82 as schematically shown in FIG. 13C with substantial additional energy removed from the projectile.

The projectile 180 then continues through the second material layer 104, which comprises KEVLAR in this example, and gathers some KEVLAR fibers near the leading edge of the projectile.

Figure 13D:
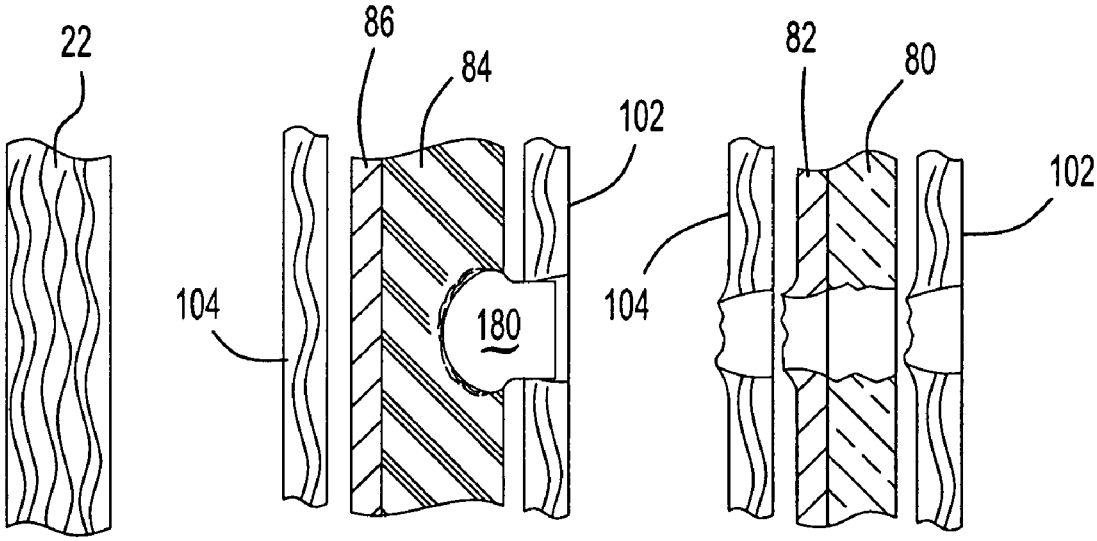

As shown in FIG. 13D, the projectile next encounters the material layer 102 in front of the ballistic material layer 84. By the time the projectile reaches the layer 84, it has gathered several fibers and the leading edge of the projectile is substantially larger than it was in the condition before it encountered the armor.

Figure 13E:
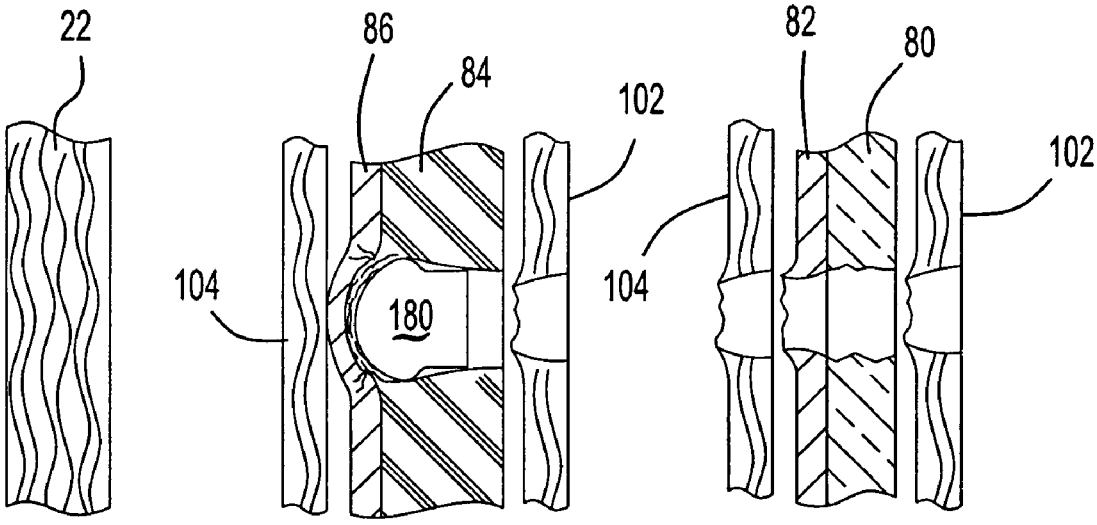

As the projectile enters the layer 84, the impact deforms and occasionally fractures the titanium backup layer 86 and initiates the so-called wadding effect where fibers of the ballistic material layer are dragged into the dent and fracture of the layer 86. The friction associated with the wadding effect removes the final energy from the projectile, effectively bringing it to a full stop within the armor assembly 30. In this example, as can be appreciated from FIG. 13E compared to FIG. 13A, the projectile is substantially deformed and completely entrapped by the armor assembly 30 before encountering the vest 22 with reduced blunt force trauma deflection. Therefore, the armor assembly 30 protects an individual wearing the body armor 20.

Having more than one rigid layer (i.e., the ceramic layer 80 and the titanium layer 86) with at least one ballistic material layer (i.e., the DYNEEMA layer 84) between the rigid layers provides a unique arrangement for making tiles that can be used as a flexible armor assembly. The layering of rigid materials with at least one ballistic material between them substantially increases the wadding effect of the material to slow down a projectile and to sufficiently deform it so that there is no likelihood of penetration through a KEVLAR vest, for example.

Although the example tiles are shown in an arrangement useful for a flexible armor assembly that can protect an individual's thoracic and abdominal region, the inventive aspects of the disclosed examples are not necessarily limited to such an application. For example, armor tiles or plates that incorporate the disclosed features may be used for other armor applications such as body extremity protection or vehicle armor.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An armor assembly, comprising:

a plurality of tiles; and a flexible tile holder that maintains an overlap dimension of overlapping portions of adjacent tiles to be at least a minimum overlap dimension and allows the overlap dimension of at least some adjacent tiles to increase beyond the minimum overlap dimension, the tile holder maintains some of the tiles in a plurality of longitudinal rows and some of the tiles in a plurality of transverse rows, the tile holder always maintains the overlap dimension of the tiles in at least one of the longitudinal rows essentially constant.

2. The assembly of claim 1, wherein the overlap dimension of the tiles in each of the transverse rows remains essentially constant.

3. The assembly of claim 1, wherein the tile holder allows the overlap dimension of the tiles in at least one other of the longitudinal rows to increase beyond the minimum overlap dimension.

4. The assembly of claim 1, wherein the overlap dimension of the tiles in no more than two of the longitudinal rows remains essentially constant.

5. The assembly of claim 1, wherein the tile holder allows adjacent ones of the tiles in one of the longitudinal rows to articulate relative to each other about axes that are generally transverse and allows adjacent ones of the tiles in one of the transverse rows to articulate relative to each other about axes that are generally longitudinal.

6. The assembly of claim 1, wherein the tile holder comprises a plurality of straps that are associated with the tiles to maintain the tiles in a selected alignment and wherein a maximum extension of the straps corresponds to the minimum overlap dimension.

7. The assembly of claim 6, wherein a first and a second strap portion are associated with two adjacent ones of the tiles and wherein the first strap maintains the minimum overlap dimension between the overlapping portions of the two adjacent tiles and the second strap portion maintains the overlap dimension below a selected maximum overlap dimension that corresponds to less than one half a width of the tiles.

8. The assembly of claim 1, wherein the tile holder comprises a plurality of pockets that each receive at least one of the tiles and wherein the pockets are secured together to maintain the tiles in a selected alignment.

9. The assembly of claim 8, wherein the tile holder comprises one layer of ballistic material on one side of the tiles and a second layer of ballistic material on an opposite side of the tiles and wherein portions of the layers are secured together to establish the pockets.

10. The assembly of claim 1, wherein at least some of the tiles have a generally planar outer surface and a correspondingly shaped inner surface and wherein the outer surface has a generally trapezoidal shape.

11. The assembly of claim 1, wherein the tiles each comprise at least one rigid material layer.

12. The assembly of claim 11, wherein the rigid material comprises a ceramic.

13. The assembly of claim 11, wherein the tiles each comprise at least one ballistic material layer.

14. The assembly of claim 1, wherein the tiles each comprise a plurality of rigid material layers and at least one ballistic material layer between the rigid material layers.

15. The assembly of claim 14, wherein at least one of the rigid material layers comprises a ceramic material.

16. The assembly of claim 14, wherein each of the tiles comprise at least one ballistic material layer that has a plurality of layers of fibers with the fibers in each of the layers being aligned parallel to each other and the fibers within each layer having fibers aligned perpendicular to the fibers in an immediately adjacent layer.

17. The assembly of claim 1, including a second plurality of tiles and a second tile holder that maintains a minimum overlap dimension of overlapping portions of adjacent ones of the second plurality of tiles and allows the overlap dimension of at least some adjacent ones of the second plurality of tiles to increase beyond the minimum overlap dimension.

18. The assembly of claim 17, wherein the plurality of tiles comprises at least one rigid material and the second plurality of tiles comprise at least one material that is different than the one rigid material.

19. The assembly of claim 17, wherein the plurality of tiles are arranged relative to the second plurality of tiles to be impacted by a projectile before the second plurality of tiles and wherein the plurality of tiles comprise a ceramic material layer secured to a metal layer and the second plurality of tiles comprise a ballistic material layer secured to a metal layer.

20. The assembly of claim 17, wherein the second plurality of tiles are arranged generally parallel to the plurality of tiles and including at least one layer of a low friction material between the pluralities.

21. An armor assembly, comprising:

a plurality of tiles;

a flexible tile holder that supports the plurality of tiles on at least one of a front side or a rear side of an individual wearing the armor assembly, the flexible tile holder maintains an overlap dimension of overlapping portions of adjacent tiles to be at least a minimum overlap dimension and allows the overlap dimension of at least some adjacent tiles to increase beyond the minimum overlap dimension;

a second plurality of tiles;

a second tile holder that supports the second plurality of tiles on the same side of the individual as the plurality of tiles, the second tile holder maintains an overlap dimension of overlapping portions of adjacent ones of the second plurality of tiles to be at least a minimum overlap dimension and allows the overlap dimension of at least some adjacent ones of the second plurality of tiles to increase beyond the minimum overlap dimension; and at least one layer of a low friction material between the pluralities and on the same side of the individual as each of the pluralities, the at least one layer is distinct from each of the flexible tile holder and the second tile holder, respectively.

* * * * *